US008624806B2

(12) United States Patent
Chung et al.

(10) Patent No.: US 8,624,806 B2
(45) Date of Patent: Jan. 7, 2014

(54) PIXEL CIRCUIT WITH NMOS TRANSISTORS AND LARGE SIZED ORGANIC LIGHT-EMITTING DIODE DISPLAY USING THE SAME AND INCLUDING SEPARATE INITIALIZATION AND THRESHOLD VOLTAGE COMPENSATION PERIODS TO IMPROVE CONTRAST RATIO AND REDUCE CROSS-TALK

(75) Inventors: Bo-Yong Chung, Yongin (KR); Keum-Nam Kim, Yongin (KR)

(73) Assignee: Samsung Display Co, Ltd., Yongin-si (KR)

( * ) Notice: Subject to any disclaimer, the term of this patent is extended or adjusted under 35 U.S.C. 154(b) by 882 days.

(21) Appl. No.: 12/716,151

(22) Filed: Mar. 2, 2010

(65) Prior Publication Data

US 2011/0063198 A1 Mar. 17, 2011

(30) Foreign Application Priority Data

Sep. 14, 2009 (KR) ..... 10-2009-0086661

(51) Int. Cl.

| | |
|---|---|
| ***G09G 3/30*** | (2006.01) |
| ***G09G 3/32*** | (2006.01) |
| ***G09G 3/34*** | (2006.01) |
| ***G06F 3/038*** | (2013.01) |
| ***G09G 5/00*** | (2006.01) |
| ***G09G 5/10*** | (2006.01) |
| ***G09G 5/02*** | (2006.01) |
| ***G09G 3/10*** | (2006.01) |

(52) U.S. Cl.

USPC ..... 345/82; 345/76; 345/77; 345/78; 345/79; 345/80; 345/81; 345/83; 345/84; 345/204; 345/205; 345/206; 345/207; 345/208; 345/209; 345/210; 345/211; 345/212; 345/213; 345/214; 345/215; 345/690; 345/691; 345/692; 345/693; 345/694; 345/695; 345/696; 345/697; 345/698; 345/699; 315/169.1; 315/169.2; 315/169.3; 315/169.4

(58) Field of Classification Search

USPC ..... 345/82

See application file for complete search history.

(56) References Cited

U.S. PATENT DOCUMENTS

| | | | | |
|---|---|---|---|---|
| 2005/0243036 | A1 | 11/2005 | Ikeda | |
| 2006/0071888 | A1 * | 4/2006 | Lee et al. | 345/82 |
| 2008/0036710 | A1 * | 2/2008 | Kim | 345/82 |
| 2009/0207105 | A1 | 8/2009 | Hwang et al. | |
| 2011/0084947 | A1 * | 4/2011 | Chung et al. | 345/211 |

FOREIGN PATENT DOCUMENTS

| | | |
|---|---|---|
| JP | 2006-276250 | 10/2006 |
| KR | 10-2009-0016333 | 2/2009 |
| KR | 10-2009-0089740 | 8/2009 |

OTHER PUBLICATIONS

Registration Determination Certificate dated Jul. 28, 2011 issued to priority application No. 10-2009-0086661, 5 pages.

* cited by examiner

*Primary Examiner* — Alexander S Beck
*Assistant Examiner* — K Kiyabu
(74) *Attorney, Agent, or Firm* — Christie, Parker & Hale, LLP

(57) ABSTRACT

A pixel circuit and an organic light-emitting diode (OLED) display using the pixel circuit is provided. The pixel circuit includes: an OLED; a third N-channel metal-oxide semiconductor (NMOS) transistor coupled to a data line and a first scan line and configured to apply a data signal to a first node; a storage capacitor having one terminal coupled to the first node and the other terminal coupled to a second node; a fourth NMOS transistor coupled between a first power and the second node and configured to apply a voltage of the first power to the second node; a first NMOS transistor having a first electrode, a second electrode, and a gate electrode coupled to the second node; and a second NMOS transistor coupled between the second node and the first electrode of the first NMOS transistor and configured to diode-connect the first NMOS transistor.

14 Claims, 6 Drawing Sheets

PIXEL CIRCUIT WITH NMOS TRANSISTORS AND LARGE SIZED ORGANIC LIGHT-EMITTING DIODE DISPLAY USING THE SAME AND INCLUDING SEPARATE INITIALIZATION AND THRESHOLD VOLTAGE COMPENSATION PERIODS TO IMPROVE CONTRAST RATIO AND REDUCE CROSS-TALK

CROSS-REFERENCE TO RELATED PATENT APPLICATION

This application claims priority to and the benefit of Korean Patent Application No. 10-2009-0086661, filed on Sep. 14, 2009, in the Korean Intellectual Property Office, the disclosure of which is incorporated herein in its entirety by reference.

BACKGROUND

1. Field

An aspect of the present invention relates to a pixel circuit and an organic light-emitting diode (OLED) display using the pixel circuit.

2. Description of the Related Art

Flat panel display devices such as liquid crystal displays (LCDs), plasma display panels (PDPs), and field emission displays (FEDs), which overcome the disadvantages of cathode-ray tubes (CRTs), have been developed. Among these display devices, OLED displays have excellent luminescence efficiency, brightness, viewing angle, and rapid response speed.

In OLED displays, an image is displayed by using OLEDs which generate light by a recombination of electrons and holes. The OLED displays have rapid response speed and are operated with low power consumption.

SUMMARY

An aspect of an embodiment of the present invention relates to a pixel circuit and an organic light-emitting diode (OLED) display using the pixel circuit, and more particularly, a pixel circuit and an OLED display using the pixel circuit which separates an initialization time so as to solve problems due to increasing the size of the OLED display.

According to an embodiment of the present invention, there is provided a pixel circuit of an organic light-emitting diode (OLED) display including: an OLED; a third N-channel metal-oxide semiconductor (NMOS) transistor coupled to a data line and a first scan line and configured to apply a data signal to a first node; a storage capacitor having one terminal coupled to the first node and the other terminal coupled to a second node; a fourth NMOS transistor coupled between a first power and the second node and configured to apply a voltage of the first power to the second node; a first NMOS transistor having a first electrode, a second electrode, and a gate electrode coupled to the second node, the first NMOS transistor configured to output a current corresponding to a voltage applied to the second node and drive the OLED; and a second NMOS transistor coupled between the second node and the first electrode of the first NMOS transistor and configured to diode-connect the first NMOS transistor.

The first electrode of the first NMOS transistor may be a drain electrode, and the second electrode of the first NMOS transistor may be a source electrode.

The pixel circuit may further include a fifth NMOS transistor coupled between the first power and the first electrode of the first NMOS transistor and configured to be turned on when a first light emitting control signal is applied from a first light emitting control line.

The pixel circuit may further include a fifth NMOS transistor coupled between the first node and a reference voltage and configured to be turned on when a second light emitting control signal is applied from a second light emitting control line.

The pixel circuit may further include a fifth NMOS transistor coupled between the first node and the first power and configured to be turned on when a second light emitting control signal is applied from a second light emitting control line.

The third NMOS transistor may be configured to transmit the data signal to the first node when a first scan signal is applied from the first scan line.

The second NMOS transistor may be configured to be turned on when a first scan signal is applied from the first scan line and diode-connect the first NMOS transistor.

The fourth NMOS transistor may be configured to be turned on when a second scan signal is applied from a second scan line.

According to another embodiment of the present invention, there is provided an organic light emitting diode (OLED) display including: first and second scan driving units respectively coupled to a plurality of scan lines for applying scan signals and a plurality of light emitting control lines for applying light emitting control signals; a data driving unit coupled to data lines for applying data signals; and a display unit including a plurality of pixel circuits coupled with the plurality of scan lines, the plurality of light emitting control lines, and the data lines, wherein each of the pixel circuits includes: an OLED; a fourth N-channel metal-oxide semiconductor (NMOS) transistor coupled to a data line of the data lines and a scan line of the scan lines and configured to apply a data signal to a first node; a storage capacitor having one terminal coupled to the first node and the other terminal coupled to a second node; a fifth NMOS transistor coupled between a first power and the second node and configured to apply a voltage of the first power to the second node; a first NMOS transistor having a first electrode, a second electrode, and a gate electrode coupled to the second node and configured to output a current corresponding to a voltage applied to the second node and drive the OLED; a second NMOS transistor coupled between the second node and the first electrode of the first NMOS transistor and configured to diode-connect the first NMOS transistor; and a third NMOS transistor coupled between the first power and the first electrode of the first NMOS transistor and configured to be turned on when a light emitting control signal is applied from a corresponding one of the light emitting control lines.

The first electrode of the first NMOS transistor may be a drain electrode, and the second electrode of the first NMOS transistor may be a source electrode.

The OLED display may further include a sixth NMOS transistor coupled between the first node and a reference voltage and configured to be turned on when a light emitting control signal is applied from another one of the light emitting control lines.

The OLED display may further include a sixth NMOS transistor coupled between the first node and the first power and configured to be turned on when a light emitting control signal is applied from said corresponding one of the light emitting control lines.

The fifth NMOS transistor may be configured to be turned on when a scan signal is applied from the scan line.

The first and second scan driving units may be configured to respectively apply a light emitting control signal from an $(n+1)^{th}$ one of the light emitting control lines and a scan signal from an $(n-1)^{th}$ one of the scan lines to overlap with each other in an initialization period.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Figure 1:
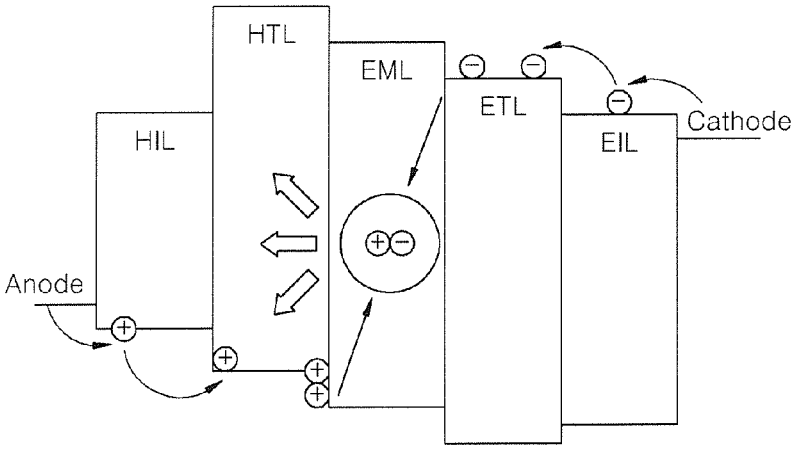
FIG. 1 (PRIOR ART)
FIG. 1 is a diagram illustrating layers of an organic light emitting diode (OLED)

Hereinafter, one or more embodiments of the present invention will be described in more detail with reference to the accompanying drawings. Like reference numerals denote like elements in the drawings.

In general, an organic light-emitting diode (OLED) display emits light by electrically exciting fluorescent organic compounds and displays an image by voltage driving or current driving of a plurality of OLEDs arranged in the form of matrix.

FIG. 1 is a diagram illustrating the layers of an OLED.

Referring to FIG. 1, the OLED includes an anode layer (e.g., indium tin oxide (ITO)), an organic thin film, and a cathode layer (e.g., metal). The organic thin film includes an emission layer (EML), an electron transport layer (ETL), and a hole transport layer (HTL) in order to balance electrons and holes so as to improve luminescent efficiency. In addition, the organic thin film may further include a hole injecting layer (HIL) or an electron-injecting layer (EIL).

Figure 2:
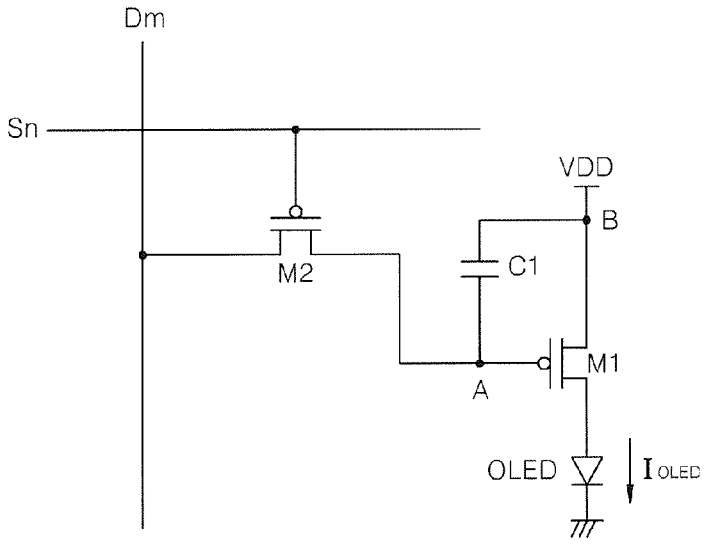
FIG. 2 (PRIOR ART)
FIG. 2 is a circuit diagram of a pixel circuit formed of P-channel metal-oxide semiconductor (PMOS) transistors.

FIG. 2 is a circuit diagram of a pixel circuit formed of P-channel metal-oxide semiconductor (PMOS) transistors.

Referring to FIG. 2, a switching transistor M2 is turned on by a selection signal from a scan line Sn, a data voltage from a data line DM is transmitted to a gate of a driving transistor M1 due to the turn-on of the switching transistor M2, and a potential difference between the data voltage and a VDD voltage of a voltage source is stored in a capacitor C1 connected between a gate and a source of the driving transistor M1. Driving current $I_{OLED}$ flows through the OLED due to the potential difference between the data voltage and the VDD voltage, and the OLED emits light. Here, according to the applied data voltage, a corresponding contrast and gradation may be displayed.

However, driving transistors M1 of a plurality of pixel circuits may each have a different threshold voltage. If the threshold voltages of the driving transistors M1 are different, current outputs from the driving transistors M1 differ, and thus a uniform image may not be displayed. The threshold voltage differences among the driving transistors M1 may increase as a size of an OLED display increases, thereby causing quality deterioration of the image displayed by the OLED display. Accordingly, in order to have a uniform image, a pixel circuit of the OLED display may compensate for the threshold voltage of a driving transistor in the pixel circuit.

There are various application circuits for compensating for the threshold voltage of the driving transistor in the pixel circuit. In most cases, initiation and compensation for the threshold voltage of the transistor may be performed at the same time in a regular period of time. In this case, undesired light may be emitted during initialization, and thus a contrast ratio (C/R) of the displayed image may be lowered. Also, as a size of the OLED display increases, a load during the initialization time increases. Thus, when initialization and compensation for the threshold voltage of the driving transistor are performed at the same time, the time needed for initialization may be relatively reduced. Thus, a pixel circuit for driving by separately performing the initialization time and the compensation for the threshold voltage is required.

Figure 3:
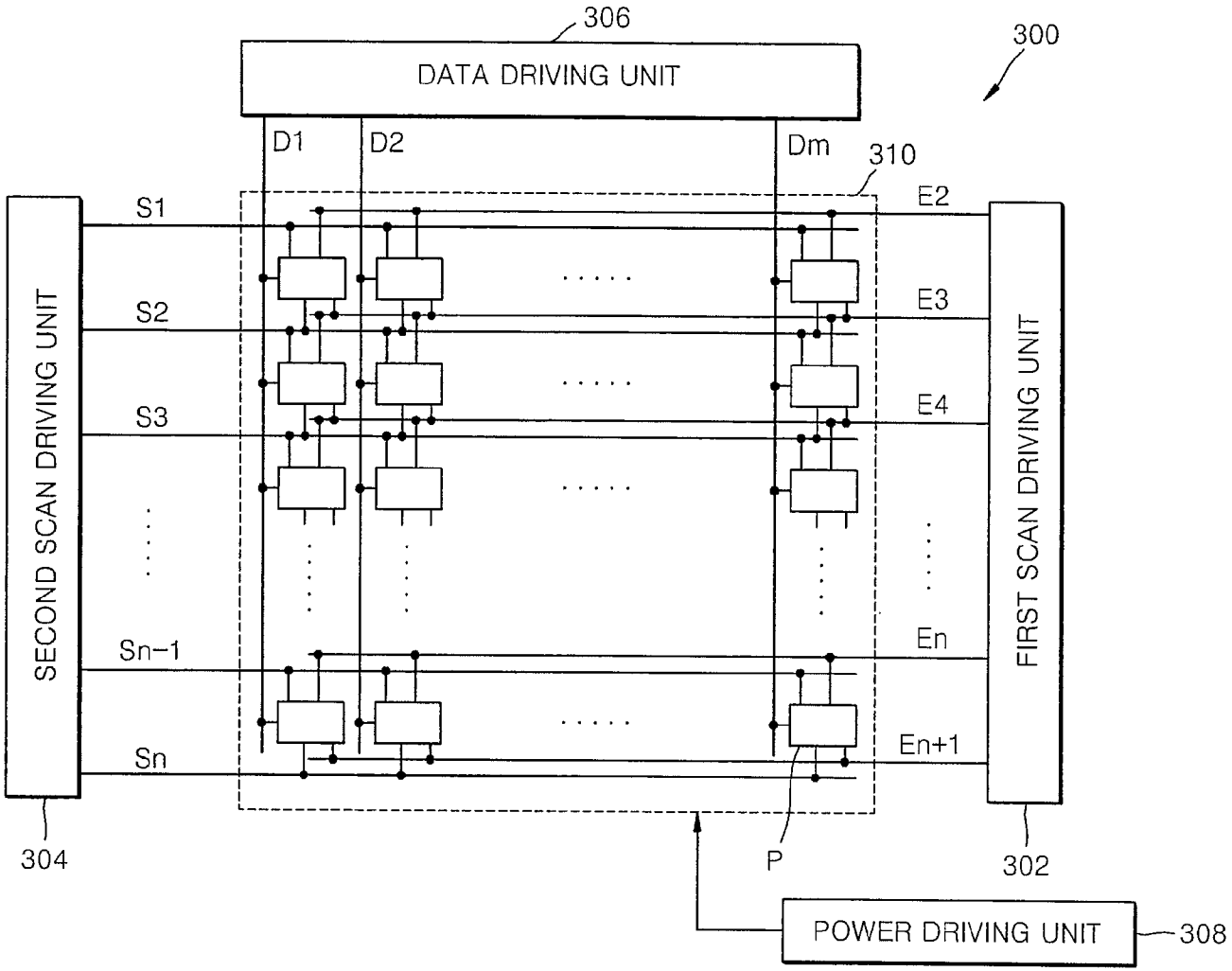
FIG. 3 is a block diagram of an OLED display according to an embodiment of the present invention.

FIG. 3 is a block diagram of an OLED display 300 according to an embodiment of the present invention.

Referring to FIG. 3, the OLED display 300 according to the embodiment of the present invention includes a display unit 310, a first scan driving unit 302, a second scan driving unit 304, a data driving unit 306, and a power driving unit 308.

The display unit 310 includes n×m pixel circuits P (where n and m are positive integers) each including an OLED, n scan lines S1, S2, . . . , and Sn which extend in a row direction and transmit scan signals, m data lines D1, D2, . . . , and Dm which extend in a column direction and transmit data signals, n light emitting control lines E2, E3, . . . , and En+1 which extend in the row direction and transmit light emitting control signals, m first and second power lines (not illustrated) for transmitting power.

The display unit 310 displays an image by emitting light using the OLEDs according to scan signals, data signals, light emitting control signals, a first power ELVDD, and a second power ELVSS.

The first scan driving unit 302 is connected to the light emitting control lines E2, E3, . . . , and En+1 and applies the light emitting control signals to the display unit 310.

The second scan driving unit 304 is connected to the scan lines S1, S2, . . . , and Sn and applies the scan signals to the display unit 310.

The data driving unit 306 is connected to the data lines D1, D2, . . . , and Dm and applies the data signals to the display unit 310. Here, the data driving unit 306 supplies data current to the plurality of pixel circuits P during a programming period.

The power driving unit 308 applies voltages including the first power ELVDD and the second power ELVSS to each of the pixel circuits P.

Figure 4:
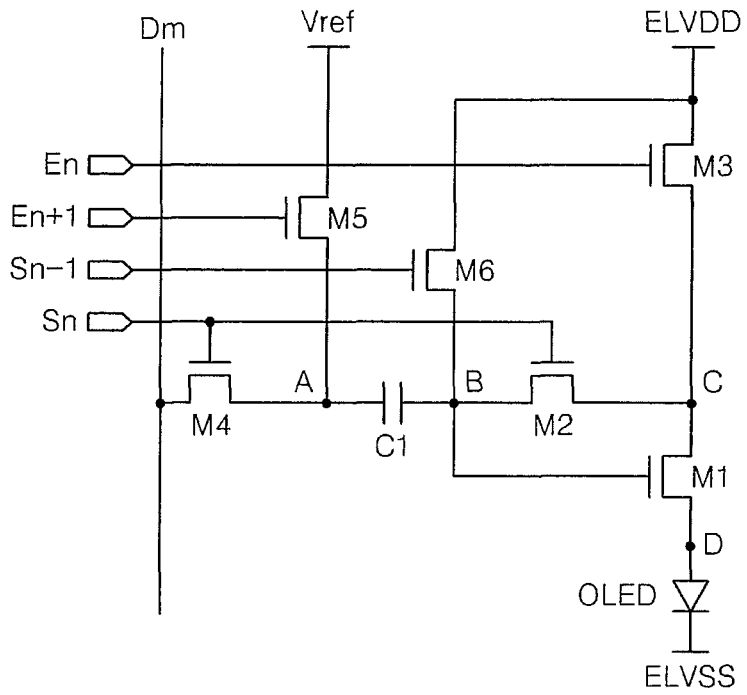
FIG. 4 is a circuit diagram of a pixel circuit employed in the OLED display of FIG. 3, according to an embodiment of the present invention.

FIG. 4 is a circuit diagram of a pixel circuit P employed in the OLED display 300 of FIG. 3, according to an embodiment of the present invention.

For the convenience of description, FIG. 4 illustrates the pixel circuit P to which an $m^{th}$ data line Dm, $(n-1)^{th}$ and $n^{th}$ scan lines Sn−1 and Sn, and $n^{th}$ and $(n+1)^{th}$ light emitting control lines En and En+1 are connected.

Referring to FIG. 4, the pixel circuit P according to the current embodiment of the present invention includes first through sixth N-channel metal-oxide semiconductor (NMOS) transistors M1, M2, M3, M4, M5, and M6 connected, directly or indirectly, to an OLED, the data line Dm, the scan lines Sn and Sn−1, and the light emitting control lines En and En+1 for controlling current supplied to the OLED, and a storage capacitor C1.

An anode electrode of the OLED is connected to the first NMOS transistor M1, which is a driving transistor, and a cathode electrode of the OLED is connected to the second power ELVSS. Here, the voltage of the second power ELVSS may be set to be significantly lower than that of the first power ELVDD, and the second power ELVSS may be set to a ground voltage GND. The OLED emits light having a brightness (e.g., a predetermined brightness) in correspondence to a current supplied from the transistor M1.

An NMOS transistor included in the pixel circuit P includes a first electrode, a second electrode, and a gate electrode, and is turned off when the control signal is low and is turned on when the control signal is high.

The NMOS transistor has a higher operating speed than that of a PMOS transistor and thus may be used in manufacturing a large-sized display. That is, electron mobility is higher than hole mobility, and the NMOS transistor uses an electron as a carrier so that the response speed of the NMOS transistor to a driving signal is faster than that of the PMOS transistor, which uses a hole as a carrier.

In addition, an amorphous-silicon (Si) transistor process may be realized with a lower cost than that of a Poly-Si process. Also, the temperature in the amorphous-Si transistor process is higher than the temperature in the Poly-Si process so that a manufacturing process using amorphous-Si is more advantageous than that of using Poly-Si. However, according to a characteristic of the amorphous-Si transistor, the pixel circuit P may be realized only by NMOS transistors. Also, according to a characteristic of the oxide TFT, a pixel may be realized only by an oxide thin film transistor (TFT).

The fourth NMOS transistor M4 is connected to the data line Dm and $n^{th}$ scan line Sn and applies a data signal to a node A when a scan signal is applied from the $n^{th}$ scan line Sn.

One terminal of the storage capacitor C1 is connected to the node A, and the other terminal of the storage capacitor C1 is connected to a node B.

The sixth NMOS transistor M6 is connected between the first power ELVDD and the node B and is turned on when a scan signal is applied from the $(n-1)^{th}$ scan line Sn−1, thereby applying a voltage of the first power ELVDD to the node B.

The gate electrode of the first NMOS transistor M1 is connected to the node B, and the first electrode of the first NMOS transistor M1, which is a drain electrode, is connected to the third NMOS transistor M3. The second electrode of the first NMOS transistor M1, which is a source electrode, is connected to the anode electrode of the OLED. The first NMOS transistor M1 supplies current, which corresponds to a voltage applied to the node B, to the second power ELVSS from the first power ELVDD through the OLED.

The second NMOS transistor M2 is connected between the node B and the first electrode of the first NMOS transistor M1 (a node C) and diode-connects the first NMOS transistor M1 when the scan signal is applied from the $n^{th}$ scan line Sn. Here, diode-connect denotes that a gate electrode and a source electrode of a transistor or a gate electrode and a drain electrode of a transistor are connected to each other so that the transistor operates as a diode.

The third NMOS transistor M3 is connected between the first power ELVDD and the first electrode of the first NMOS transistor M1 (the node C) and is turned on when a light emitting control signal is applied from the $n^{th}$ light emitting control line En.

The fifth NMOS transistor M5 is connected between the node A and a reference voltage Vref and is turned on when a light emitting control signal is applied from the $(n+1)^{th}$ light emitting control line En+1. Here, the fifth NMOS transistor M5 may be connected between the node A and the first power ELVDD and may be turned on when a light emitting control signal is applied from the $(n+1)^{th}$ light emitting control line En+1.

The driving of the pixel circuit P is described below in more detail with reference to a timing diagram of FIG. 5.

Figure 5:
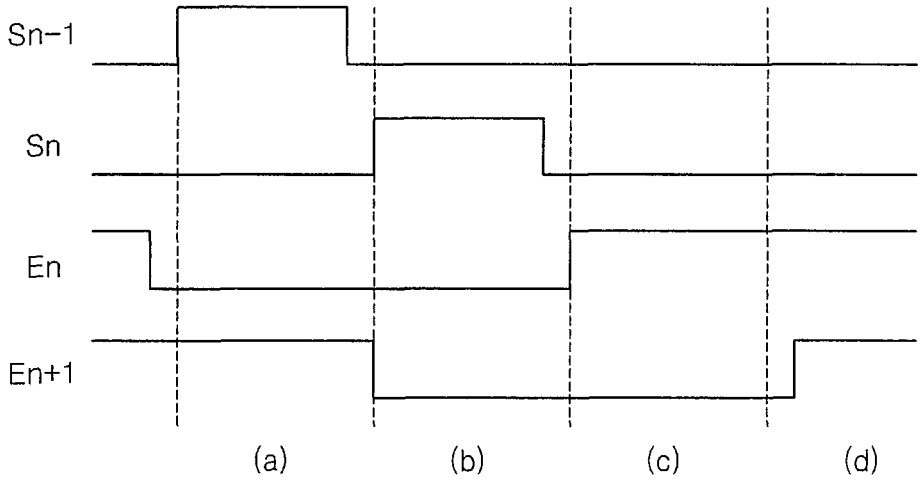
FIG. 5 is a timing diagram of the pixel circuit of FIG. 4.

FIG. 5 is a timing diagram of the pixel circuit P of FIG. 4, according to one embodiment of the present invention.

Referring to FIG. 5, a first period (a) is an initialization period and is where the $(n-1)^{th}$ scan line Sn−1 and the $(n+1)^{th}$ light emitting control line En+1 are applied with logic high signals. A second period (b) is a period for compensating for a threshold voltage of the OLED and a threshold voltage of a driving transistor, and is where data is written to the storage capacitor C1 and the $n^{th}$ scan line Sn is applied with a logic high signal. In a third period (c), the $n^{th}$ light emitting control line En is applied with a logic high signal. In a fourth period (d), the OLED emits light and the $(n+1)^{th}$ light emitting control line En+1 is applied with a logic high signal.

The driving of the pixel circuit P according to each period of the timing diagram of FIG. 5 is described in more detail below.

Figure 6:
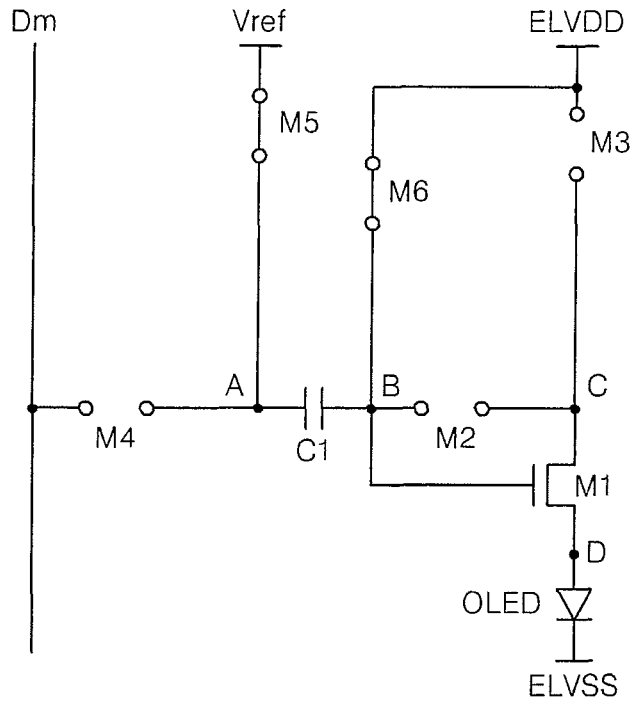
FIGS. 6, 7, 8, and 9 are circuit diagrams for illustrating driving of the pixel circuit of FIG. 4 according to the timing diagram of FIG. 5.

FIG. 6 illustrates driving of the pixel circuit P during the initialization period, which is the first period (a).

Figure 7:
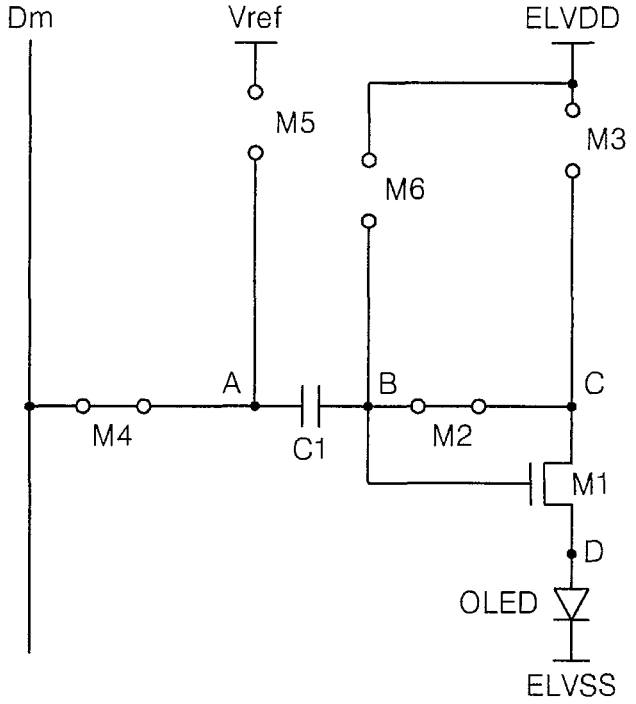

FIG. 7 illustrates that the threshold voltage of the driving transistor is compensated for and the data signal is applied in the second period (b).

Figure 8:
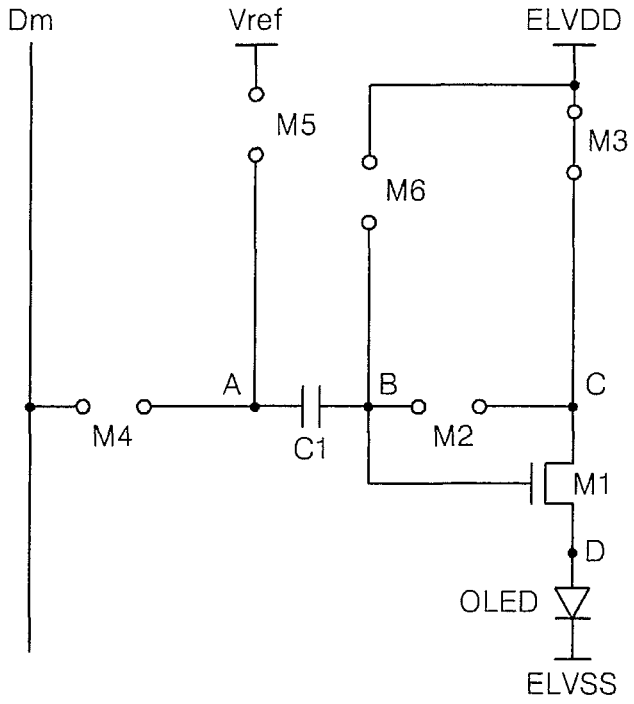
Figure 9:
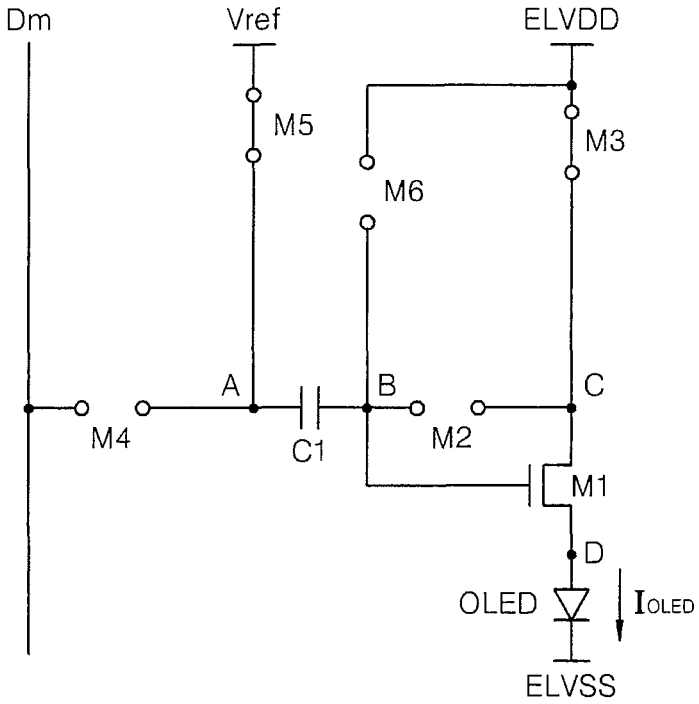

FIG. 8 illustrates driving in the third period (c), and FIG. 9 illustrates that the OLED emits light in the fourth period (d).

The pixel circuit in the first period (a) has the connection as shown in FIG. 6. The $(n-1)^{th}$ scan line Sn−1 and the $(n+1)^{th}$ light emitting control line En+1 are applied with logic high signals in the first period (a) as shown in the timing diagram of FIG. 5. Accordingly, the fifth NMOS transistor M5 is turned on, and thus the reference voltage Vref is applied to the node A. In addition, the sixth NMOS transistor M6 is turned on, and a voltage of the first power ELVDD is applied to the node B. Accordingly, the storage capacitor C1 connected between the node A and the node B is initialized.

The pixel circuit in the second period (b) has the connection as shown in FIG. 7. Only the $n^{th}$ scan line Sn is applied with a logic high signal in the second period (b) as shown in the timing diagram of FIG. 5. Accordingly, the fourth NMOS transistor M4 and the second NMOS transistor M2 are turned on. The fourth NMOS transistor M4 is turned on, and thus a data voltage is applied to the node A. Also, the second NMOS transistor M2 is turned on, and thus the first NMOS transistor M1, which is the driving transistor, is diode-connected. Accordingly, the node B has a voltage corresponding to the threshold voltage of the driving transistor and the threshold voltage of the OLED. Thus, an electric charge based on a voltage corresponding to the deviation of the voltage of the node B and the data voltage applied to the node A is charged to the terminals of the storage capacitor C1.

The pixel circuit P in the third period (c) has the connection as shown in FIG. 8. Only the $n^{th}$ light emitting control line En is applied with a logic high signal in the third period (c) as shown in the timing diagram of FIG. 5. Accordingly, only the third NMOS transistor M3 is turned on, and a voltage of the first power ELVDD is applied to the first electrode of the first NMOS transistor M1, which is the node C.

The pixel circuit in the fourth period (d) has the connection as shown in FIG. 9. The $n^{th}$ light emitting control line En and the $(n+1)^{th}$ light emitting control line En+1 are applied with logic high signals in the fourth period (d) as shown in the timing diagram of FIG. 5. Accordingly, while the fifth NMOS transistor M5 is turned on, the reference voltage Vref is applied to the node A, and while the third NMOS transistor M3 is turned on, the voltage of the first power ELVDD is applied to the first electrode of the first NMOS transistor M1. In this case, the voltage of the node B corresponds to a voltage corresponding to the sum of the threshold voltage of the driving transistor and the threshold voltage of the OLED and the voltage difference between the reference voltage and the data voltage, as represented in Equation 1.

$$\text{the voltage of the node}B = Vto + Vth + (Vref - V\text{data}) \qquad \text{Equation 1}$$

Vto: threshold voltage of OLED
Vth: threshold voltage of driving transistor
Vref: reference voltage
Vdata: data voltage Next, when current flows through the OLED from the first NMOS transistor M1, the voltage of the node B changes to a voltage represented in Equation 2.

$$\text{the voltage of the node}B = Vto + Vth + (Vref - V\text{data}) + (Voled - Vto + ELVSS) \qquad \text{Equation 2}$$

Voled: voltage of OLED when OLED emits light
ELVSS: voltage of second power

Also, a voltage of a node D where the second electrode of the first NMOS transistor M1 is connected to the OLED corresponds to the sum of the voltage of the second power ELVSS and a voltage across the terminals of the OLED while the current flows through the OLED, as represented in Equation 3.

$$\text{the voltage of the node}D = Voled + ELVSS \qquad \text{Equation 3}$$

Finally, a driving current flowing through the OLED is as shown in Equation 4.

$$\begin{aligned} Ioled &= K(Vgs - Vth)^2 \qquad \text{Equation 4} \\ &= K\{(Vto + Vth + (Vref - Vdata) + (Voled - Vto + ELVSS) - (Voled + ELVSS)) - Vth\}^2 \\ &= K\{Vth + (Vref - Vdata) - Vth\}^2 \\ &= K(Vref - Vdata)^2 \end{aligned}$$

$Ioled$: driving current flowing through the $OLED$ $K = \beta/2$, $K$: constant, $\beta$: gain factor According to Equation 4, the driving current $I_{oled}$ flowing through the OLED is determined by the reference voltage Vref and the data voltage Vdata. That is, the current flows through the OLED regardless of the threshold voltage Vth of the first NMOS transistor M1, which is the driving transistor, the threshold voltage Vto of the OLED, and the voltage of the second power ELVSS.

Thus, the pixel circuit according to the current embodiment of the present invention compensates for the threshold voltage of the driving transistor and is not sensitive to voltage deviations of the first power and the second power, thereby achieving uniform brightness.

Unlike a pixel circuit in which initialization and compensation for the threshold voltage of the driving transistor are performed in a first period, in an embodiment of the present invention, initialization is performed in the first period, and the threshold voltage of the driving transistor is compensated for in the second period. Accordingly, problems in that initialization is not completely performed in some parts of the pixel circuits due to a large-sized panel and a high load due to fast operation may be resolved. As such, in order to separate an initialization period of the storage capacitor from the period of compensating for the threshold voltage of the driving transistor, a light emitting control signal and the sixth NMOS transistor M6 are further added in one embodiment of the present invention.

In addition, the sixth NMOS transistor M6 is used to separate the initialization time, and thus a contrast ratio (C/R) may be improved in one embodiment of the present invention. In the related art, current flows through the OLED during the initialization period; however, a transistor is further added to perform initialization in the embodiment of the present invention. Accordingly, current does not flow through the OLED during the initialization period, and thus the OLED does not emit light, thereby improving the C/R.

In the embodiment of the present invention, a light emitting control driver for transmitting a light emitting control signal is included so that duty control is available and motion blur may be removed.

In addition, cross-talk is reduced in the embodiment of the present invention.

Figure 10:
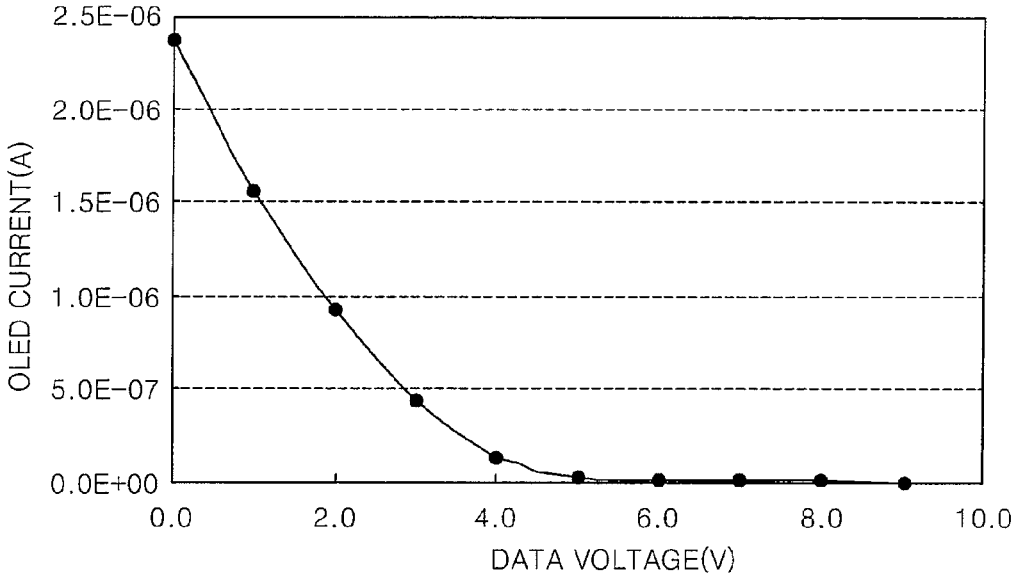
FIG. 10 is a graph showing a simulation result of a pixel circuit, according to an embodiment of the present invention.

FIG. 10 is a graph showing a simulation result of the pixel circuit P, according to an embodiment of the present invention.

Referring to FIG. 10, a change of driving current $I_{oled}$ flowing through the OLED according to the data voltage Vdata may be identified. Referring to Equation 4, the driving current $I_{oled}$ flowing through the OLED is changed according to the data voltage Vdata in the pixel circuit according to the current embodiment, and the result is as shown in FIG. 10.

Figure 11:
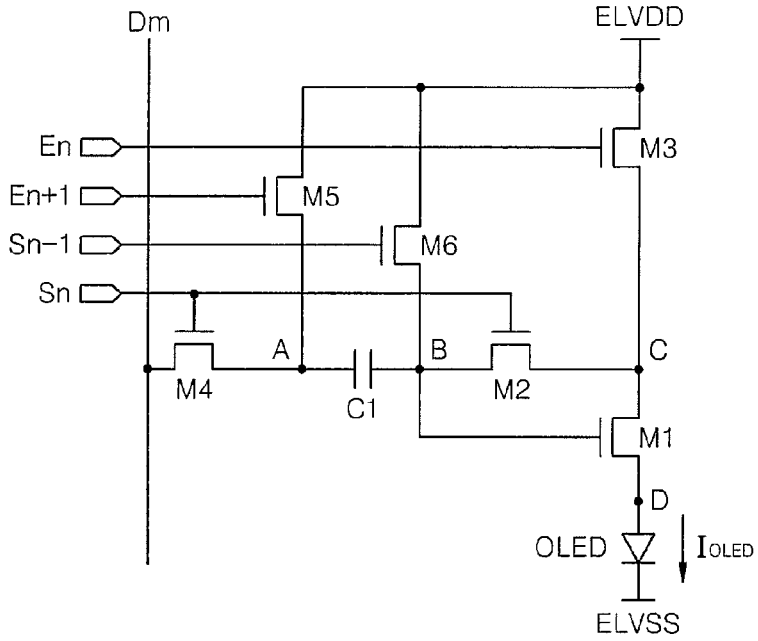
FIG. 11 is a circuit diagram of a pixel circuit employed in the OLED display of FIG. 3, according to another embodiment of the present invention.

FIG. 11 is a circuit diagram of a pixel circuit employed in the OLED display 300 of FIG. 3, according to another embodiment of the present invention.

Elements in the pixel circuit of FIG. 11 that correspond to the elements in the pixel circuit of FIG. 4 are the same or perform similar functions. Thus, a detailed description thereof is omitted.

Also, the pixel circuit according to the embodiment illustrated in FIG. 11 is different from the pixel circuit described with reference to FIGS. 4 and 5 in that the fifth NMOS transistor M5 is connected to the first power ELVDD, instead of to the reference voltage Vref. The driving methods are the same or similar with those described with reference to FIG. 4, and thus a detailed description thereof is omitted.

In FIG. 11, the driving current $I_{oled}$ flowing through the OLED included in the pixel circuit is determined by the voltage of the first power ELVDD and the data voltage Vdata, as represented in Equation 5.

$$\begin{aligned} Ioled &= K(Vgs - Vth)^2 \qquad \text{Equation 5} \\ &= K\{(Vto + Vth + (ELVDD - Vdata) + (Voled - Vto + ELVSS) - (Voled + ELVSS)) - Vth\}^2 \\ &= K\{Vth + (ELVDD - Vdata) - Vth\}^2 \\ &= K(ELVDD - Vdata)^2 \end{aligned}$$

In addition, in the pixel circuit of FIG. 4 or FIG. 11, the fifth NMOS transistor M5 may be connected to the $n^{th}$ light emitting control line En, instead of the $(n+1)^{th}$ light emitting control line En+1, so that the $n^{th}$ light emitting control signal may be applied in the third period. That is, the present invention may include various modifications and is not limited to the above described embodiments.

According to the embodiments of the present invention, an initialization period of the pixel circuit is separated from a period of compensating for the threshold voltage of the driving transistor so as to solve the problems of a large sized OLED display and to improve C/R and reduce cross-talk.

In addition, the threshold voltage of the driving transistor is compensated for, and thus an image having uniform brightness may be displayed.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A pixel circuit of an organic light-emitting diode (OLED) display comprising:

an OLED;

a third N-channel metal-oxide semiconductor (NMOS) transistor coupled to a data line and a first scan line and configured to apply a data signal to a first node;

a storage capacitor having one terminal coupled to the first node and the other terminal coupled to a second node;

a fourth NMOS transistor coupled between a first power and the second node and configured to apply a voltage of the first power to the second node;

a first NMOS transistor having a first electrode, a second electrode, and a gate electrode coupled to the second node, the first NMOS transistor configured to output a current corresponding to a voltage applied to the second node and drive the OLED; and a second NMOS transistor coupled between the second node and the first electrode of the first NMOS transistor and configured to diode-connect the first NMOS transistor.

2. The pixel circuit of claim 1, wherein the first electrode of the first NMOS transistor is a drain electrode, and the second electrode of the first NMOS transistor is a source electrode.

3. The pixel circuit of claim 1, further comprising a fifth NMOS transistor coupled between the first power and the first electrode of the first NMOS transistor and configured to be turned on when a first light emitting control signal is applied from a first light emitting control line.

4. The pixel circuit of claim 1, further comprising a fifth NMOS transistor coupled between the first node and a reference voltage and configured to be turned on when a second light emitting control signal is applied from a second light emitting control line.

5. The pixel circuit of claim 1, further comprising a fifth NMOS transistor coupled between the first node and the first power and configured to be turned on when a second light emitting control signal is applied from a second light emitting control line.

6. The pixel circuit of claim 1, wherein the third NMOS transistor is configured to transmit the data signal to the first node when a first scan signal is applied from the first scan line.

7. The pixel circuit of claim 1, wherein the second NMOS transistor is configured to be turned on when a first scan signal is applied from the first scan line and diode-connect the first NMOS transistor.

8. The pixel circuit of claim 1, wherein the fourth NMOS transistor is configured to be turned on when a second scan signal is applied from a second scan line.

9. An organic light emitting diode (OLED) display comprising:

a first scan driving unit coupled to a plurality of light emitting control lines for applying light emitting control signals;

a second scan driving unit coupled to a plurality of scan lines for applying scan signals;

a data driving unit coupled to data lines for applying data signals; and a display unit comprising a plurality of pixel circuits coupled with the plurality of scan lines, the plurality of light emitting control lines, and the data lines, wherein each of the pixel circuits comprises:

an OLED;

a fourth N-channel metal-oxide semiconductor (NMOS) transistor coupled to a data line of the data lines and a scan line of the scan lines and configured to apply one of the data signals to a first node;

a storage capacitor having one terminal coupled to the first node and the other terminal coupled to a second node;

a fifth NMOS transistor coupled between a first power and the second node and configured to apply a voltage of the first power to the second node;

a first NMOS transistor having a first electrode, a second electrode, and a gate electrode coupled to the second node, the first NMOS transistor being configured to output a current corresponding to a voltage applied to the second node and drive the OLED;

a second NMOS transistor coupled between the second node and the first electrode of the first NMOS transistor and configured to diode-connect the first NMOS transistor; and a third NMOS transistor coupled between the first power and the first electrode of the first NMOS transistor and configured to be turned on when a light emitting control signal is applied from a corresponding one of the light emitting control lines.

10. The OLED display of claim 9, the first electrode of the first NMOS transistor is a drain electrode, and the second electrode of the first NMOS transistor is a source electrode.

11. The OLED display of claim 9, further comprising a sixth NMOS transistor coupled between the first node and a reference voltage and configured to be turned on when a light emitting control signal is applied from another one of the light emitting control lines.

12. The OLED display of claim 9, further comprising a sixth NMOS transistor coupled between the first node and the first power and configured to be turned on when a light emitting control signal is applied from said corresponding one of the light emitting control lines.

13. The OLED display of claim 9, wherein the fifth NMOS transistor is configured to be turned on when a scan signal is applied to the gate of the fifth NMOS transistor.

14. The OLED display of claim 9, wherein the first and second scan driving units are configured to respectively apply a light emitting control signal from an $(n+1)^{th}$ one of the light emitting control lines and a scan signal from an $(n-1)^{th}$ one of the scan lines to overlap with each other in an initialization period.

* * * * *